US010845050B2

(12) United States Patent
Kanazawa

(10) Patent No.: US 10,845,050 B2
(45) Date of Patent: Nov. 24, 2020

(54) PREMIXING DEVICE AND COMBUSTION DEVICE

(71) Applicant: PALOMA CO., LTD, Aichi (JP)

(72) Inventor: Koki Kanazawa, Aichi (JP)

(73) Assignee: PALOMA CO., LTD, Aichi (JP)

( * ) Notice: Subject to any disclaimer, the term of this patent is extended or adjusted under 35 U.S.C. 154(b) by 72 days.

(21) Appl. No.: 16/253,478

(22) Filed: Jan. 22, 2019

(65) Prior Publication Data

US 2019/0346134 A1 Nov. 14, 2019

(30) Foreign Application Priority Data

May 9, 2018 (JP) ..... 2018-090847

(51) Int. Cl.

| | |
|---|---|
| ***F23D 14/62*** | (2006.01) |
| ***F23D 14/60*** | (2006.01) |
| ***F23D 14/64*** | (2006.01) |
| ***F23N 5/24*** | (2006.01) |
| ***F23N 1/02*** | (2006.01) |

(52) U.S. Cl.

CPC ..... *F23D 14/60* (2013.01); *F23D 14/64* (2013.01); *F23N 1/022* (2013.01); *F23N 5/242* (2013.01); *F23D 2900/00003* (2013.01); *F23D 2900/14642* (2013.01)

(58) Field of Classification Search

CPC . F23D 14/64; F23D 14/60; F23D 2900/00003
See application file for complete search history.

(56) References Cited

U.S. PATENT DOCUMENTS

| | | | | |
|---|---|---|---|---|
| 4,657,504 A * | 4/1987 | Akiyama | ..... | F23D 14/66 431/166 |
| 9,097,419 B2 | 8/2015 | Zatti et al. | | |
| 2013/0224670 A1* | 8/2013 | Zatti | ..... | F23D 14/04 431/38 |

FOREIGN PATENT DOCUMENTS

| | | | | |
|---|---|---|---|---|
| CA | 2309490 A1 * | 11/2001 | ..... | F23K 5/007 |
| JP | 2015230143 A | 12/2015 | | |
| JP | 2016513783 A | 5/2016 | | |
| JP | 2017036889 A | 2/2017 | | |

* cited by examiner

*Primary Examiner* — Jason Lau
(74) *Attorney, Agent, or Firm* — Maier & Maier, PLLC

(57) ABSTRACT

A premixing device includes a first and a second venturi in which air flows by rotation of a centrifugal fan, first and second communication openings disposed in the venturis, respectively, for allowing fuel gas supplied from a gas supply passage to flow out, a flap valve capable of opening and closing the second venturi on a side downstream of the second communication opening, and an equalizing valve disposed in the gas supply passage on a side upstream of the first and the second communication openings. The gas supply passage, which connects between an outlet of the equalizing valve and the first and the second communication openings, diverges from the outlet of the equalizing valve to independently form a first gas passage and a first straight path, and a second gas passage and a second straight path for the venturis, respectively.

2 Claims, 14 Drawing Sheets

PREMIXING DEVICE AND COMBUSTION DEVICE

This application claims the benefit of Japanese Patent Application Number 2018-090847 filed on May 9, 2018, the entirety of which is incorporated by reference.

FIELD

The disclosure relates to a premixing device that generates air-fuel mixture by mixing fuel gas with air, and a combustion device having a burner for combusting air-fuel mixture generated by the premixing device.

BACKGROUND

In a combustion device used for a hot water supply apparatus and the like, a premixing type (all primary air type) burner for combusting air-fuel mixture obtained by fuel gas and all the air necessary for combustion being mixed with each other, is used in some cases. When the burner is used, a premixing device for previously mixing air with fuel gas to generate air-fuel mixture is used.

As the premixing device, Japanese Laid-Open Patent Publication No. 2017-36889 discloses, for example, a premixing device that includes a chamber, a venturi portion and an intake fan. The chamber stores fuel gas supplied from a fuel gas passage. The venturi portion has a gap through which the fuel gas in the chamber flows into air flow, and mixes the fuel gas that has flowed through the gap, into air flow. The intake fan draws air flow in the venturi portion. In particular, in this premixing device, an air adjusting valve is disposed on the upstream side of a passage portion of the venturi portion, and a fuel gas adjusting valve is disposed in the fuel gas passage on the upstream side of the chamber, and both the valves are simultaneously adjusted by an interlocking mechanism, thereby obtaining a great turndown ratio.

Furthermore, Japanese Laid-Open Patent Publication No. 2015-230143 similarly discloses a premixing device that has a butterfly valve, a switching valve and a cushion spring. The butterfly valve is disposed on the upstream side of a passage portion of a venturi portion. The switching valve is disposed on the upstream side of a gas chamber for switching airflow resistance between low resistance and high resistance in conjunction with the butterfly valve. The cushion spring is incorporated in an interlocking mechanism for operating both the valves in conjunction with each other. In this premixing device, when the butterfly valve is moved from an opening position to a closing position, the switching valve is previously closed, whereas, when the butterfly valve is moved from the closing position to the opening position, the switching valve is maintained in the closing position by an urging force of the cushion spring until the butterfly valve rotates by a predetermined angle. Thus, air-fuel mixture is prevented from being gas rich when the airflow resistance is switched from high resistance to low resistance.

Meanwhile, in the venturi portion having such a configuration, improvement of the turndown ratio is limited. Therefore, a dual venturi is also considered. In the dual venturi, two venturis are aligned in parallel with each other, and switching between a case where the two venturis are used and a case where one venturi is closed and only the other venturi is used is performed according to a required combustion amount. In this case, a turndown ratio is greatly improved, and the minimum gas amount can be reduced, which leads to improvement of usability.

For example, U.S. Pat. No. 9,097,419 discloses a premix burner in which the inside of one housing is sectioned into two portions, to form two venturis, and a flap valve for opening and closing the passage is disposed on the downstream side of one of the venturis, and diverging passages formed by diverging a gas passage are connected to the venturis, respectively. In this premix burner, when wind from a fan indicates a predetermined amount or smaller amount, the flap valve closes so as to close one of the venturis, and air and fuel gas flow in only the other of the venturis, thereby restricting an amount of wind and increasing a turndown ratio.

Furthermore, Japanese Translation of PCT International Application Publication No. 2016-513783 discloses a dual venturi. In the dual venturi, the inside of a housing having a flow passage narrowed at the center is sectioned into a first air supply portion and a second air supply portion by a first separation wall. Further, in the dual venturi, a first gas supply portion and a second gas supply portion are separately formed by sectioning by a second separation wall. The first gas supply portion communicates with the first air supply portion and the second gas supply portion communicates with the second air supply portion. An opening and closing means for simultaneously opening and closing the second air supply portion and the second gas supply portion is disposed in the mid-portion of the housing.

In this dual venturi, the opening and closing means operates such that, when a low heat amount is required, the second air supply portion and the second gas supply portion are interrupted, and only air and fuel gas that flow through the first air supply portion and the first gas supply portion are mixed, and supplied to a burner, whereas, when a high heat amount is required, the second air supply portion and the second gas supply portion are opened, and air and fuel gas that flow through the second air supply portion and the second gas supply portion are also mixed, and supplied to the burner, thereby allowing a low heat amount or a high heat amount to be selectively outputted according to a required heat amount.

SUMMARY

However, in the venturi structures disclosed in Japanese Laid-Open Patent Publication Nos. 2017-36889 and 2015-230143, an amount of wind is restricted by the air adjusting valve or the butterfly valve disposed on the inlet side of the venturi, so that negative pressure is increased on the venturi side, and differential pressure of gas is increased although an amount of wind is reduced, and an amount of gas is increased, thereby causing imbalance of an air ratio or the like in combustion. Therefore, in Japanese Laid-Open Patent Publication Nos. 2017-36889 and 2015-230143, a gas adjusting valve is necessary for restricting an amount of gas in conjunction with the air adjusting valve, thereby complicating the structure and increasing cost.

Such change of balance in combustion is caused similarly in U.S. Pat. No. 9,097,419 and Japanese Translation of PCT International Application Publication No. 2016-513783. In the dual venturi structure disclosed in U.S. Pat. No. 9,097,419, also when the flap valve is closed, the gas diverging passages are connected on the upstream side, whereby air on the closed venturi side may flow back and air-fuel mixture containing an increased amount of air may flow into the opened-side venturi. In order to prevent this, another valve for opening and closing the gas passage needs to be disposed on the upstream side of the flap valve.

Moreover, in the dual venturi structure disclosed in Japanese Translation of PCT International Application Publication No. 2016-513783, an outlet of the second gas supply portion is disposed on the upstream side of a damper for opening and closing the first air supply portion, whereby only gas may flow from the second gas supply portion into the first air supply portion when the first air supply portion is closed by the damper. Therefore, also in this case, a valve member for opening and closing the outlet of the second gas supply portion in conjunction with the damper needs to be disposed, thereby complicating the structure and increasing cost.

Therefore, an object of the disclosure is to provide a premixing device and a combustion device that can prevent backflow of air and maintain balance in combustion with a simple structure while employing a dual venturi structure that allows a great turndown ratio to be obtained.

In order to attain the aforementioned object, a first aspect of the disclosure is directed to a premixing device for generating air-fuel mixture by mixing fuel gas with air by using a fan to supply the air-fuel mixture to a burner. The premixing device includes two venturis, a communication opening, an opening and closing means, and an equalizing valve. In the two venturis, air flows by rotation of the fan. The communication opening is disposed in each of the venturis and configured to allow fuel gas supplied from a gas supply passage to flow out. The opening and closing means is capable of opening and closing one of the venturis on a side downstream of the communication opening. The equalizing valve is disposed in the gas supply passage on a side upstream of the communication opening. In the premixing device, the gas supply passage that connects between an outlet of the equalizing valve and the two communication openings diverges from the outlet of the equalizing valve to form independent gas supply passages for the venturis, respectively.

In a second aspect of the disclosure based on the first aspect, the gas supply passage, which diverges and is formed for one of the venturis where the opening and closing means is disposed, may include a gas switching means that can open and close the gas supply passage and that closes the gas supply passage when the one of the venturis is closed by the opening and closing means.

In a third aspect of the disclosure based on the second aspect, the two gas supply passages may diverge upward and downward from the outlet of the equalizing valve, and may be parallel with each other so as to overlap each other in an up-down direction before one of the gas supply passages reaches the gas switching means.

In a fourth aspect of the disclosure based on the third aspect, one of the gas supply passages which overlaps the other thereof on an upper side may reach the gas switching means, and may be thereafter bent downward, and may extend downward so as to be positioned at the same height as the other of the gas supply passages, and the two gas supply passages may be connected to the communication openings at the same height.

In order to attain the aforementioned object, a fifth aspect of the disclosure is directed to a combustion device that includes the premixing device according to any one of the first to the fourth aspects, a fan configured to allow air to flow in the two venturis of the premixing device, and a burner to which air-fuel mixture generated by the premixing device is supplied.

According to the first aspect and the fifth aspect of the disclosure, in a dual venturi structure in which two venturis are provided and one of the venturis can be opened and closed by the opening and closing means, the gas supply passage that connects between the outlet of the equalizing valve and the two communication openings diverges from the outlet of the equalizing valve to form independent gas supply passages for the venturis, respectively. Therefore, when one of the venturis is closed, backflow of air from the gas supply passage for the one of the venturis can be prevented. Thus, change of balance of an air ratio or the like in combustion can be inhibited with a simple structure, and air can be prevented from being excessively contained in air-fuel mixture.

According to the second aspect of the disclosure, in addition to the above-described effect being obtained, the gas switching means is disposed. When one of the venturis is closed by the opening and closing means, the gas switching means closes the gas supply passage for the one of the venturis. Therefore, when the other of the venturis is singly used, backflow of air can be assuredly prevented.

According to the third aspect of the disclosure, in addition to the above-described effects being obtained, the two gas supply passages diverge upward and downward from the outlet of the equalizing valve, and are parallel with each other so as to overlap each other in the up-down direction before one of the gas supply passages reaches the gas switching means. Therefore, the two gas supply passages can be formed so as to save a space.

According to the fourth aspect of the disclosure, in addition to the above-described effects being obtained, one of the gas supply passages which overlaps the other thereof on the upper side reaches the gas switching means, and is thereafter bent downward, and extends downward so as to be positioned at the same height as the other of the gas supply passages, and the two gas supply passages are connected to the communication openings at the same height. Therefore, the two gas supply passages that extend from the gas switching means to the communication openings can be easily formed.

DETAILED DESCRIPTION

An embodiment of the disclosure will be described below with reference to the drawings.

Figure 1:
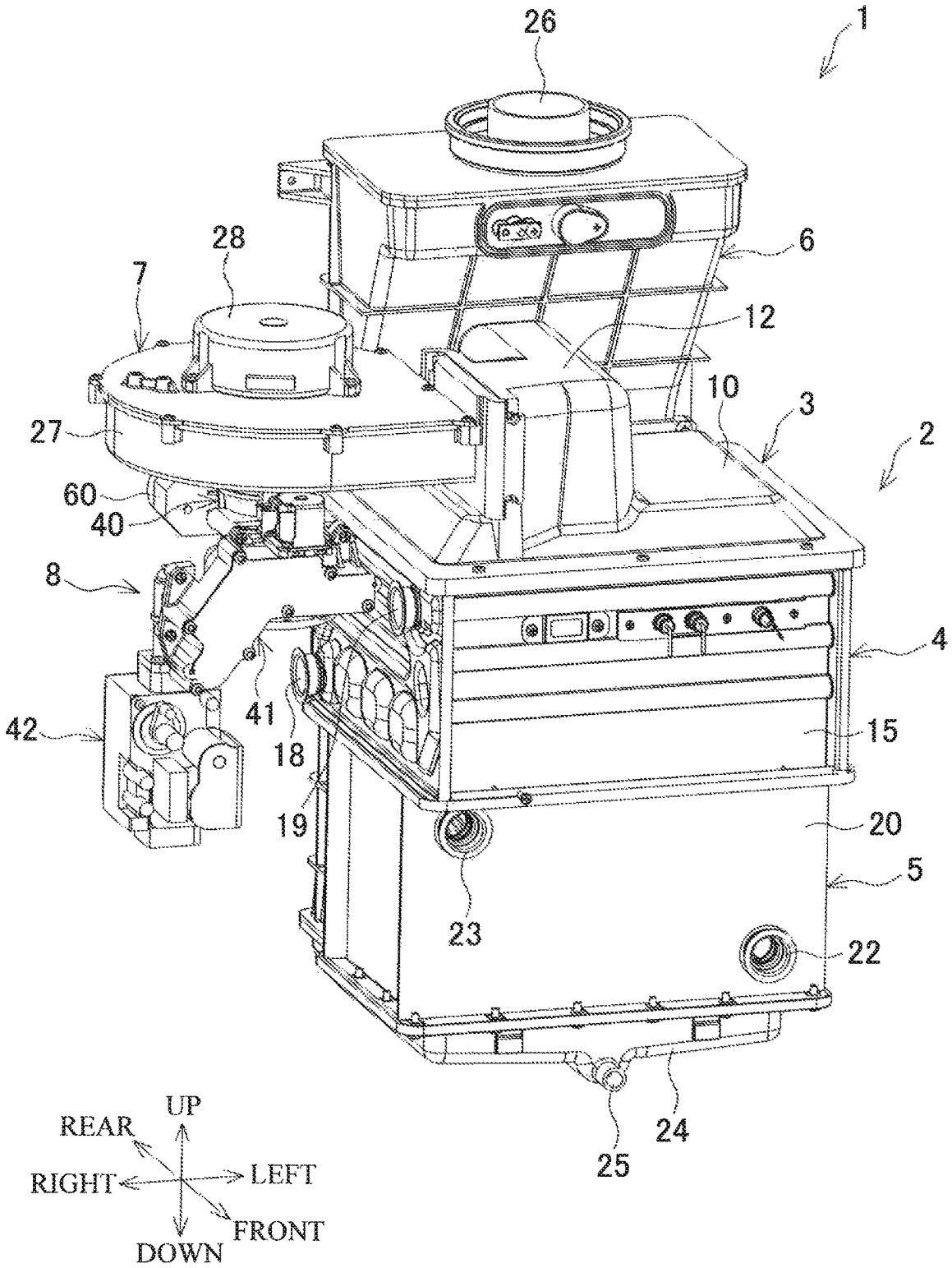
FIG. 1 is a perspective view of a hot water supply apparatus.
Figure 2:
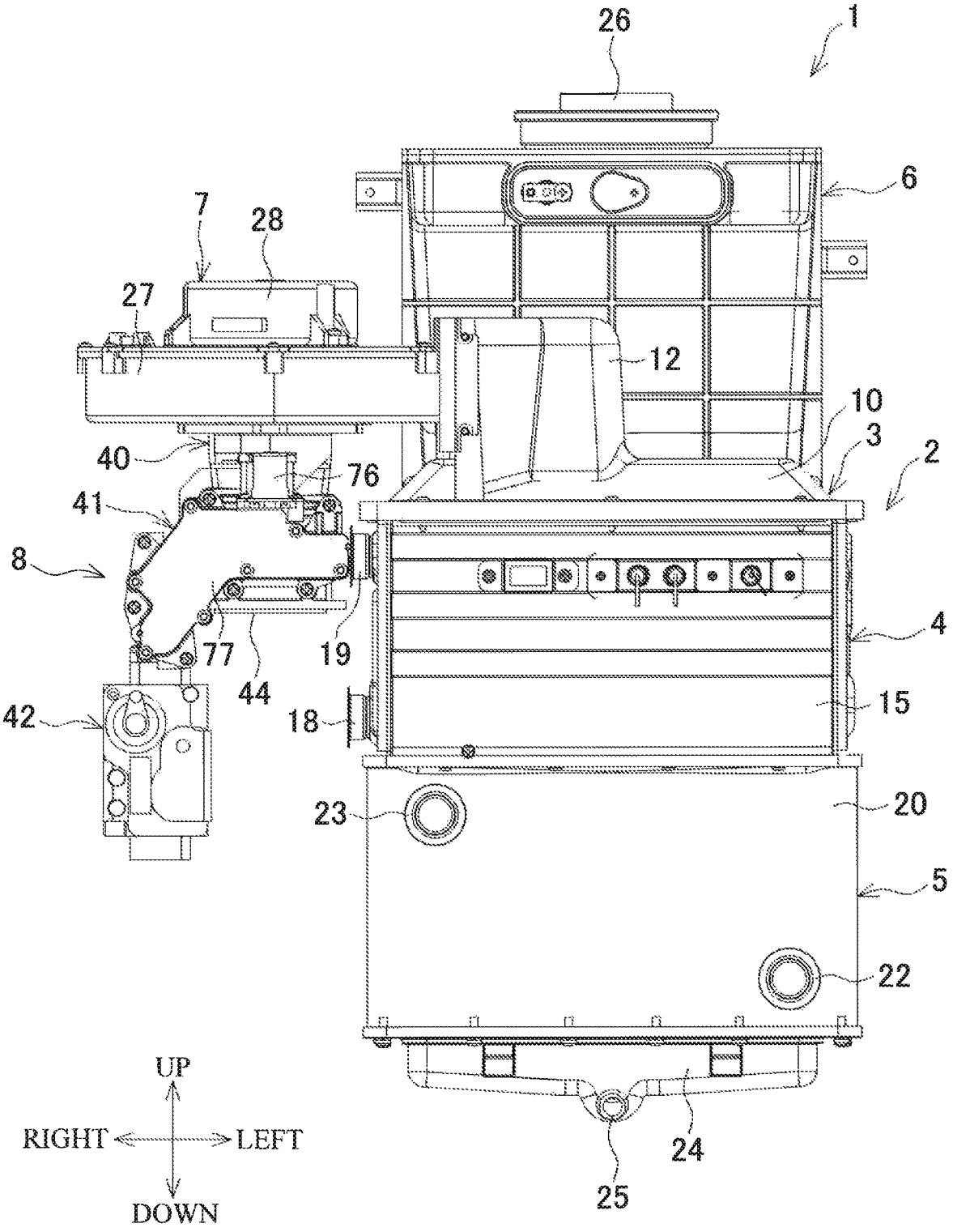
FIG. 2 is a front view of the hot water supply apparatus.
Figure 3:
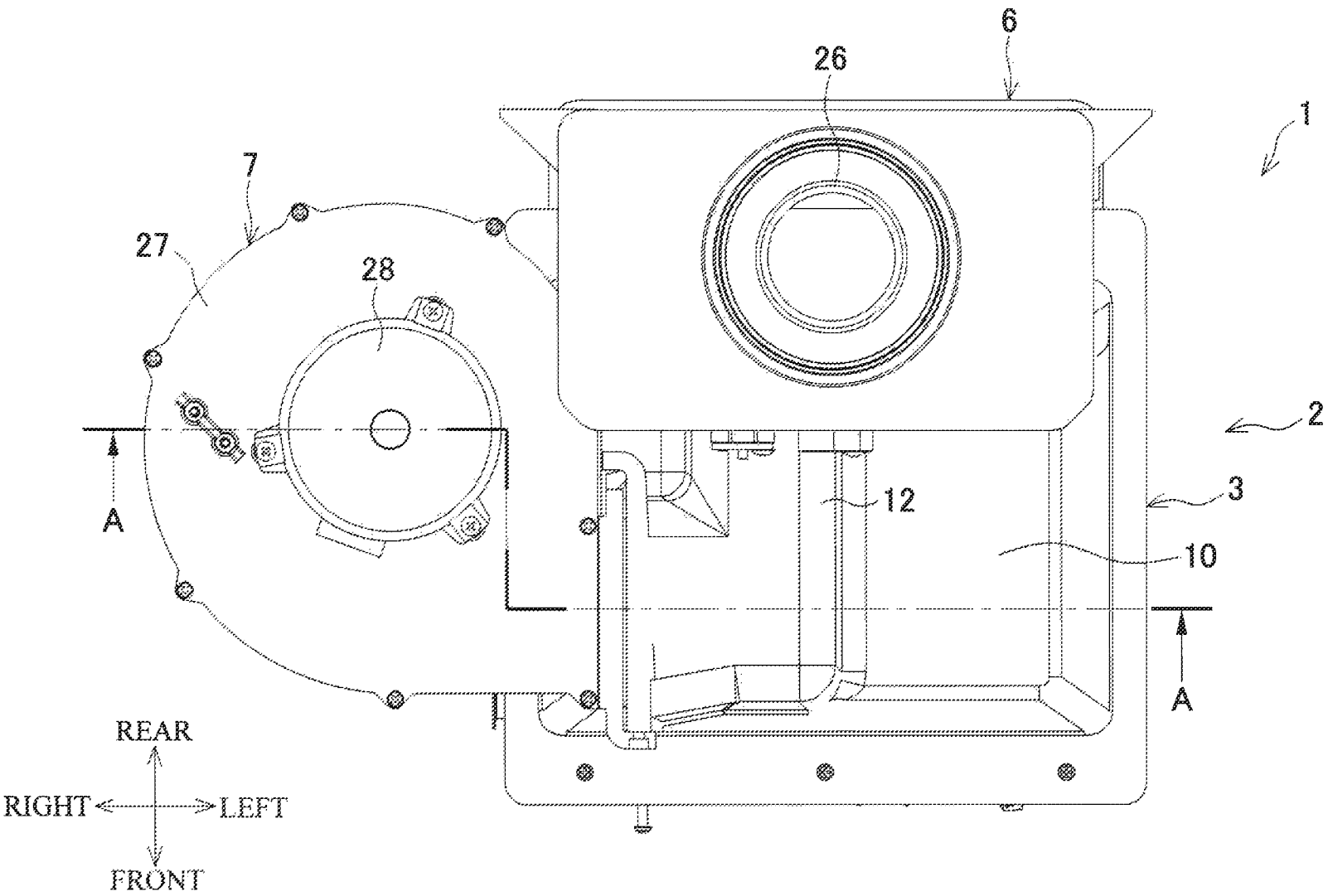
FIG. 3 is a plan view of the hot water supply apparatus.
Figure 4:
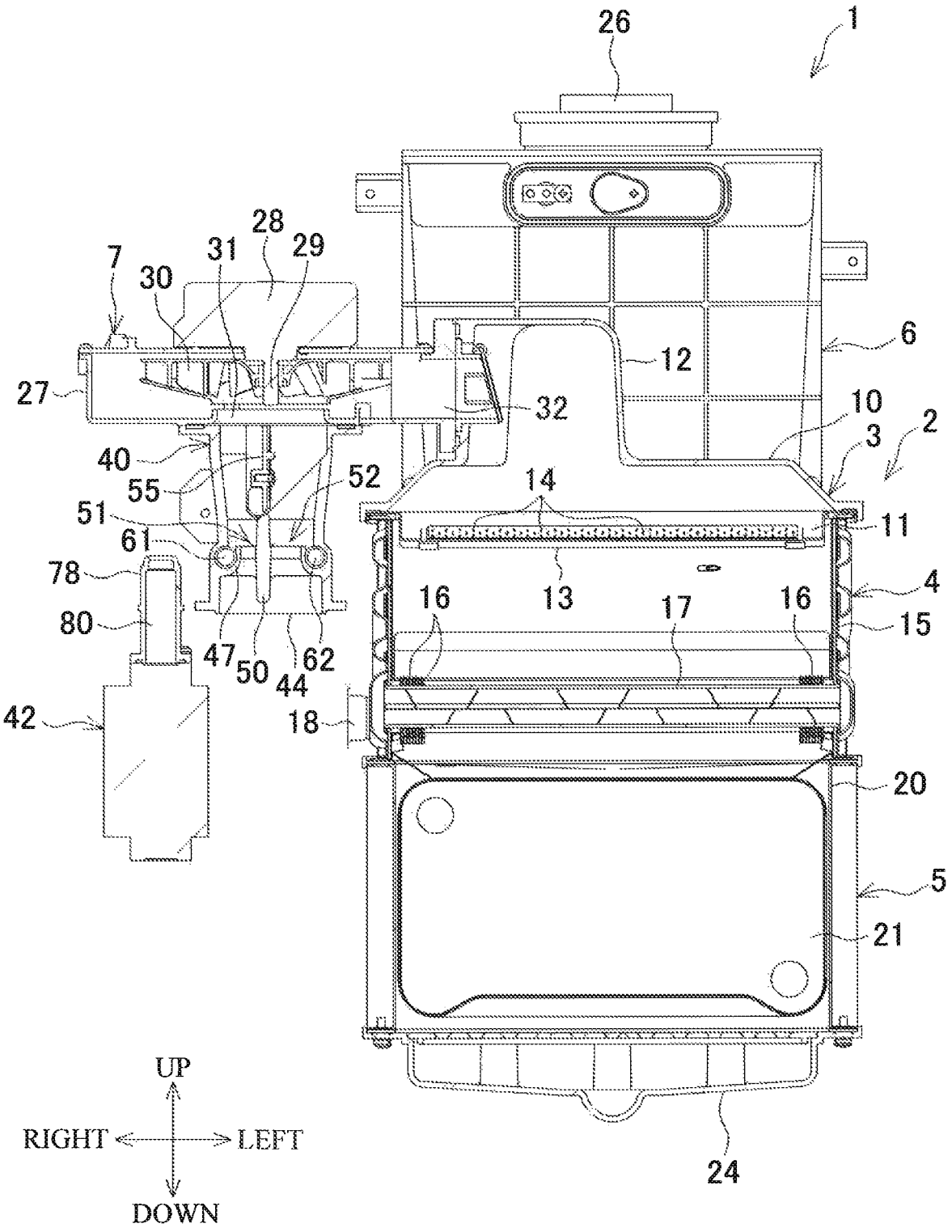
FIG. 4 is a cross-sectional view taken along a line A-A in FIG. 3.

FIG. 1 is a perspective view of a hot water supply apparatus that is an example of a combustion device having a premixing device, FIG. 2 is a front view thereof, FIG. 3 is a plan view thereof, and FIG. 4 is a cross-sectional view taken along a line A-A in FIG. 3.

A hot water supply apparatus 1 includes a main body 2, an exhaust unit 6, a fan unit 7, and a premixing device 8. The main body 2 has a burner unit 3, a primary heat exchanger 4, and a secondary heat exchanger 5 in order, respectively, from the upper side. The exhaust unit 6 is disposed in the rear of the main body 2 so as to be oriented upward. The fan unit 7 is connected to the burner unit 3 on the right side of the main body 2. The premixing device 8 is connected to the lower side of the fan unit 7.

The burner unit 3 has an upper plate 10, and a lower plate 11 that is attached to the lower portion of the upper plate 10 and that projects into an intermediate casing 15 of the primary heat exchanger 4, as shown in FIG. 4. The upper plate 10 has a deep bottom portion 12 formed so as to project upward and have an opened side surface. The lower plate 11 includes a flame hole plate 13 having a plurality of flame holes 14 formed therein.

The primary heat exchanger 4 has a plurality of fins 16, and a heat transfer tube 17 in the lower portion of the intermediate casing 15 to which the burner unit 3 is attached. The plurality of fins 16 are aligned at predetermined intervals in the right-left direction. The heat transfer tube 17 penetrates through each fin 16 in a meandering manner. The end portion of the heat transfer tube 17 projects on the right side surface of the intermediate casing 15. An inlet-side connection opening 18 is disposed at the lower portion on the far side, and an outlet-side connection opening 19 is disposed at the upper portion on the front side. A hot water supply tube (not illustrated) is connected to the outlet-side connection opening 19.

The secondary heat exchanger 5 has a plurality of heat transfer plates 21. In a lower casing 20 that communicates with the intermediate casing 15, the plurality of heat transfer plates 21 form projections and recesses, are aligned at predetermined intervals in the front-rear direction, and form an internal flow passage continuous between the heat transfer plates 21. An inlet 22 is disposed at the lower portion on the front side of the lower casing 20, and an outlet 23 is disposed at the upper portion on the front side the lower casing 20. The inlet 22 and the outlet 23 are connected to the internal flow passage. A water supply tube (not illustrated) is connected to the inlet 22, and the outlet 23 is connected to the inlet-side connection opening 18 of the primary heat exchanger 4 through piping (not illustrated). A lower cover 24 that receives drain is disposed at the lower portion of the lower casing 20, and a drain discharge outlet 25 projects at the lower portion on the front surface.

The exhaust unit 6 has such a quadrangular tubular shape that the lower front surface thereof is connected to the lower rear surface of the lower casing 20, and an exhaust pipe 26 is disposed at the upper end so as to extend upward beyond the burner unit 3.

The fan unit 7 has a fan motor 28 and a centrifugal fan 3. The fan motor 28 is mounted at the center on the upper surface of a fan case 27 such that the fan motor 28 is oriented downward. The fan case 27 has a round shape in a planer view. The centrifugal fan 30 is fixed to a rotation shaft 29 that projects into the fan case 27. An intake opening 31 is formed at the center in the lower surface of the fan case 27, and a blowout opening 32 is formed on the side surface of the fan case 27. The left side surface of the fan case 27 is connected to the deep bottom portion 12 of the upper plate 10 of the burner unit 3, and the blowout opening 32 communicates with the inside of the deep bottom portion 12.

Figure 5:
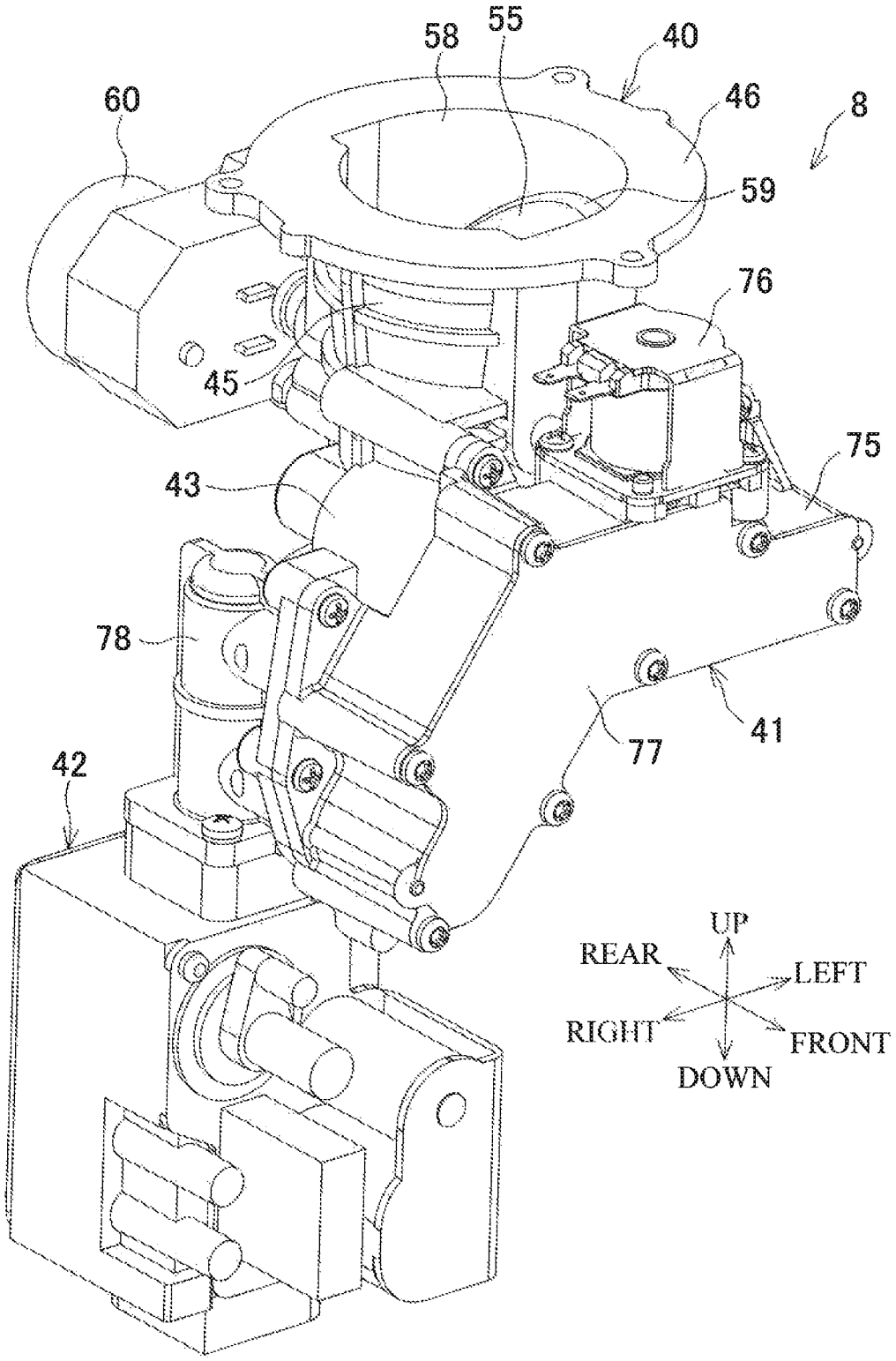
FIG. 5 is a perspective view of a premixing device.
Figure 6:
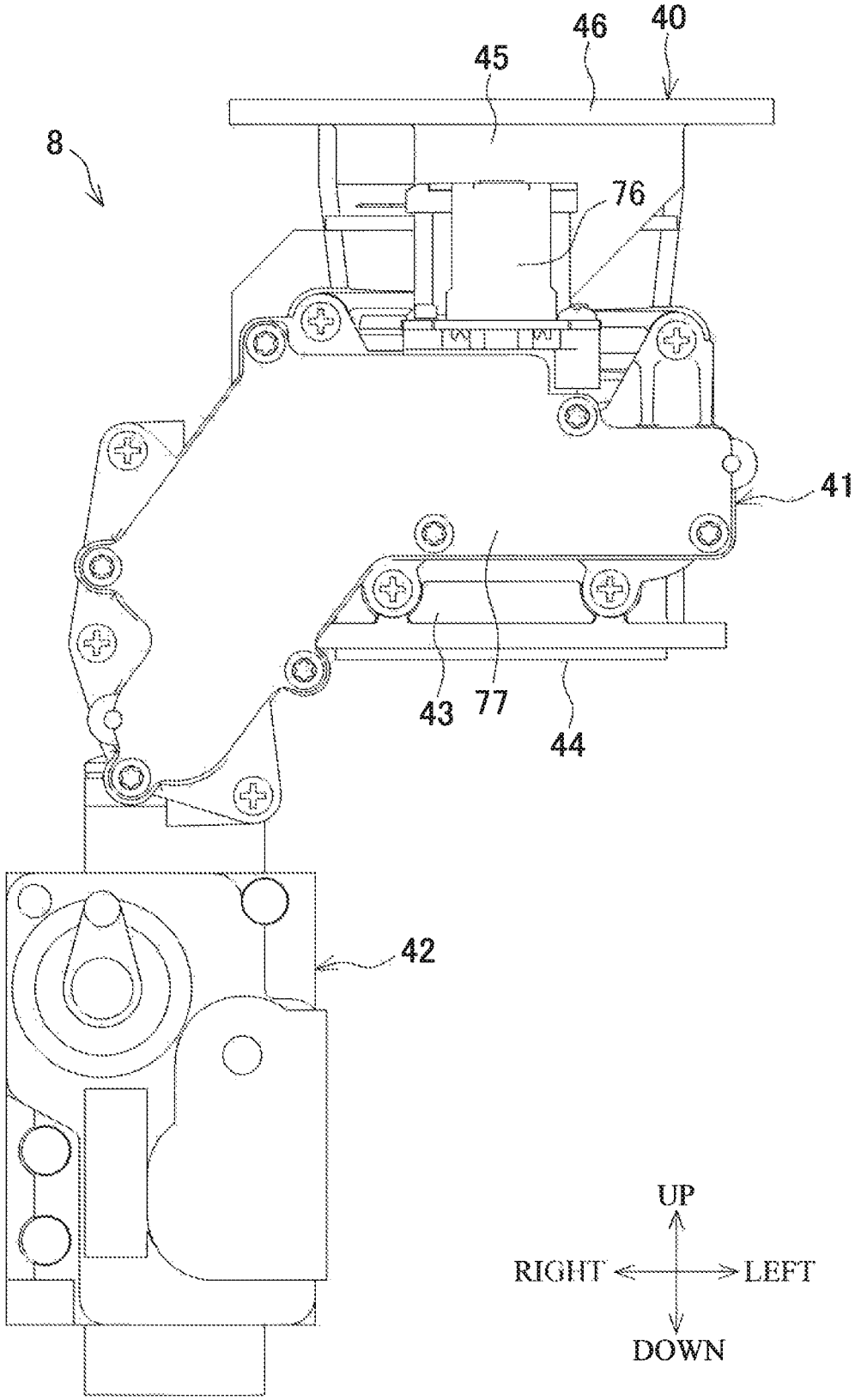
FIG. 6 is a front view of the premixing device.

A structure of the premixing device 8 will be described in detail. FIG. 5 is a perspective view of the premixing device 8, FIG. 6 is a front view thereof, FIG. 7A is a plan view thereof, and FIG. 7B is a cross-sectional view, of a mixing tube portion, taken along a line B-B.

The premixing device 8 includes a mixing tube 40, a gas passage portion 41 and an equalizing valve 42. The mixing tube 40 is connected to the lower surface of the fan case 27 in a state where the mixing tube 40 is connected to the intake opening 31. The gas passage portion 41 is disposed on the front surface side of the mixing tube 40 for supplying fuel gas to the mixing tube 40. The equalizing valve 42 is connected to the lower end of the gas passage portion 41.

Figure 7B:
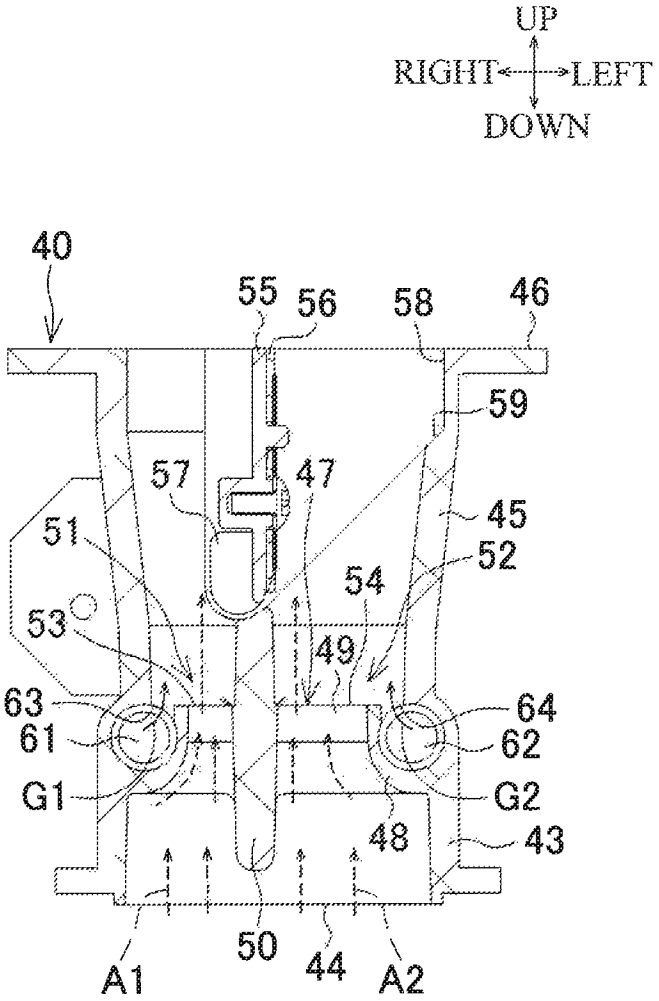
FIG. 7B is a cross-sectional view of a mixing tube portion of the premixing device as taken along a line B-B in FIG. 7A.
Figure 7A:
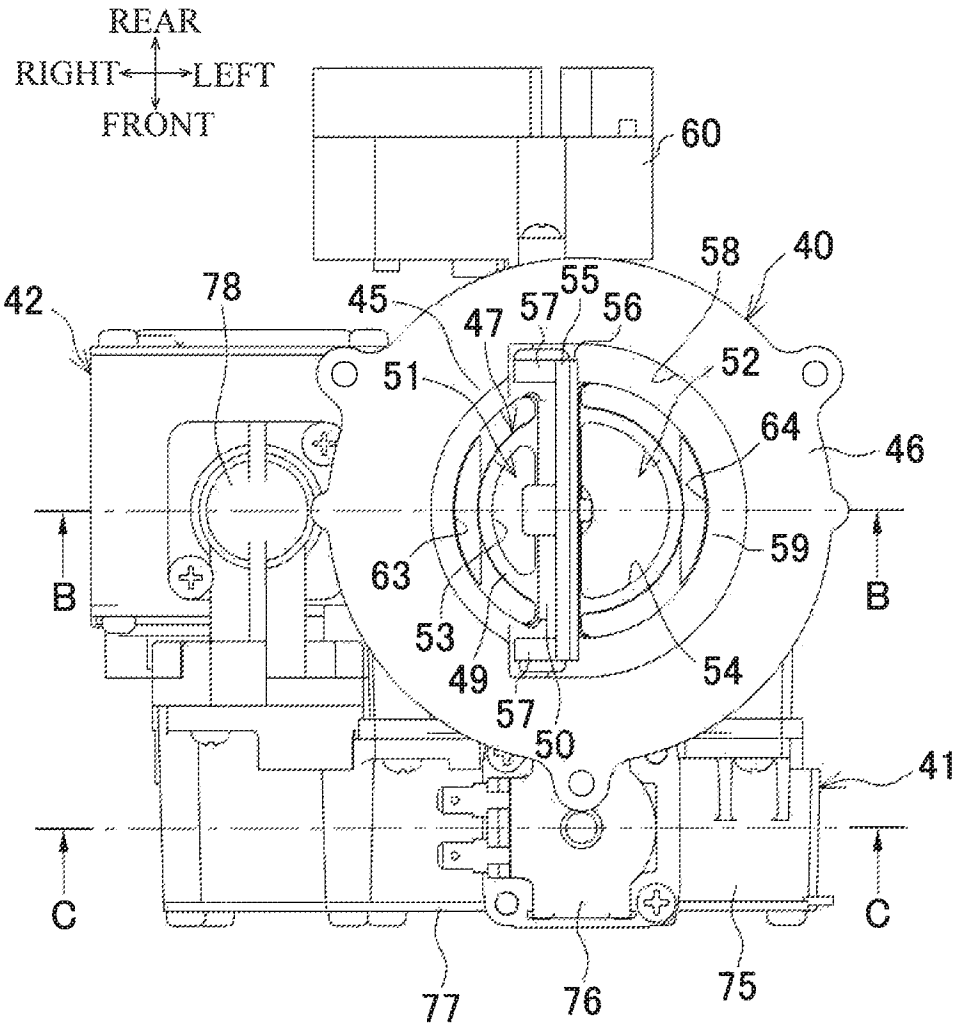
FIG. 7A is a plan view of the premixing device in which a flap valve is at an opening position.

As shown in FIG. 7A and FIG. 7B, the mixing tube 40 includes a lower tube portion 43 and an upper tube portion 45. The lower tube portion 43 is formed so as to have an introduction opening 44 for air at the lower end and have a constant diameter in the up-down direction. The upper tube portion 45 is formed continuously from the upper end of the lower tube portion 43 so as to be coaxial with the lower tube portion 43, have the diameter enlarged toward the upper side, and have a flange 46 formed at the upper end. The flange 46 is attached to the lower surface of the fan case 27, and the upper tube portion 45 communicates with the intake opening 31 so as to be coaxial with the intake opening 31.

A pressure reducing portion 47 is connected continuously in the lower tube portion 43 so as to be coaxial with the lower tube portion 43. The pressure reducing portion 47 has a reduction portion 48 and a narrowing portion 49. The reduction portion 48 is disposed on the lower end side, is connected to the intermediate portion, in the up-down direction, of the lower tube portion 43 over the entire circumference, and has its diameter reduced so as to form such a curved surface that is gradually oriented upward toward the center. The narrowing portion 49 extends to the upper end of the lower tube portion 43 so as to have its diameter slightly reduced from the upper end of the reduction portion 48. That is, a nozzle shape is formed such that air drawn through the introduction opening 44 is restricted by the reduction portion 48 to pass through the pressure reducing portion 47 having a small passage area.

Furthermore, in the mixing tube 40, a partition wall 50 is formed so as to extend from the lower tube portion 43 to the pressure reducing portion 47 and the lower portion of the upper tube portion 45 in the up-down direction, and divides the inside of the mixing tube 40 into two portions that are the left and right portions. The partition wall 50 is positioned so as to be eccentric from the axis in the mixing tube 40 and is shifted rightward. In the mixing tube 40, a first venturi 51 and a second venturi 52 are formed. The first venturi 51 passes through a small crescent-shaped first gap 53 that penetrates, in the up-down direction, through a portion to the right of the partition wall 50, and is opened to the narrowing portion 49 of the pressure reducing portion 47. The second venturi 52 passes through a large half-moon-shaped second gap 54 that penetrates, in the up-down direction, through a portion to the left of the partition wall 50, and is opened to the narrowing portion 49 of the pressure reducing portion 47.

Furthermore, in the upper tube portion 45, a flap valve 55 is disposed, as an opening and closing means, on the upper side of the partition wall 50. The flap valve 55 is a semi-circular plate member having a seal plate 56 secured to the back surface. The flap valve 55 has support portions 57 disposed at both ends, in the front-rear direction, of the lower end of the flap valve 55. The support portions 57 are held on the upper side of the partition wall 50 so as to be rotatable in a recess 58 formed in the upper tube portion 45. On the second venturi 52 side in the recess 58, a U-shaped valve seat 59 is formed so as to be tilted leftward from the upper end of the partition wall 50 in the upper direction.

Figure 8B:
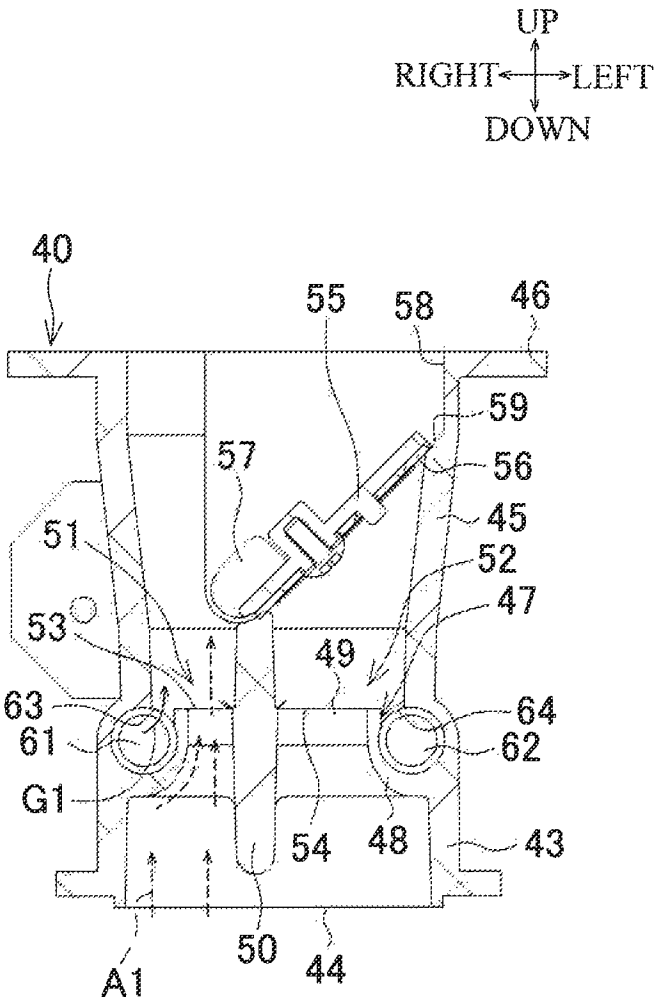
FIG. 8B is a cross-sectional view of the mixing tube portion of the premixing device as taken along a line B-B in FIG. 8A.
Figure 8A:
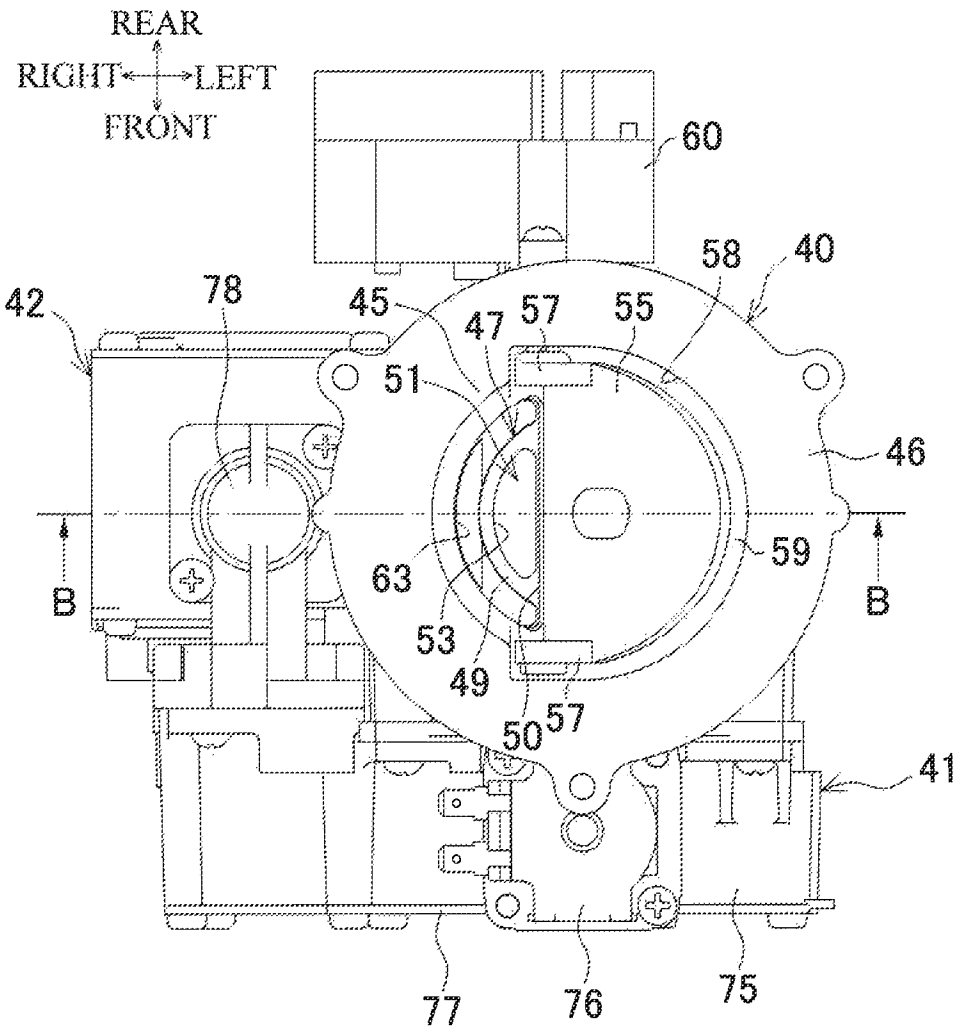
FIG. 8A is a plan view of the premixing device in which the flap valve is at a closing position.

A valve driving motor 60 is disposed on the rear surface of the mixing tube 40, and a motor shaft (not illustrated) of the motor 60 is connected to the support portion 57 on the rear side. Therefore, the flap valve 55 is swingable, by rotation of the valve driving motor 60, between an opening position at which the flap valve 55 stands toward the extension of the upper side of the partition wall 50 to open the second venturi 52 as shown in FIG. 7A and FIG. 7B, and a closing position at which the flap valve 55 is tilted downward until the seal plate 56 contacts with the valve seat 59 to close the second venturi 52 as shown in FIG. 8A and FIG. 8B.

In the mixing tube 40, a first straight path 61 and a second straight path 62 are disposed between the upper end of the lower tube portion 43 and the upper end of the pressure reducing portion 47 so as to be bilaterally symmetric around the pressure reducing portion 47. Each of the first straight path 61 and the second straight path 62 has a columnar shape, has a closed rear end, and extends forward. A crescent-shaped first communication opening 63 is formed, on the upper side of the first straight path 61, so as to communicate with the first venturi 51. A crescent-shaped second communication opening 64 is formed, on the upper side of the second straight path 62, so as to communicate with the second venturi 52.

Figure 11:
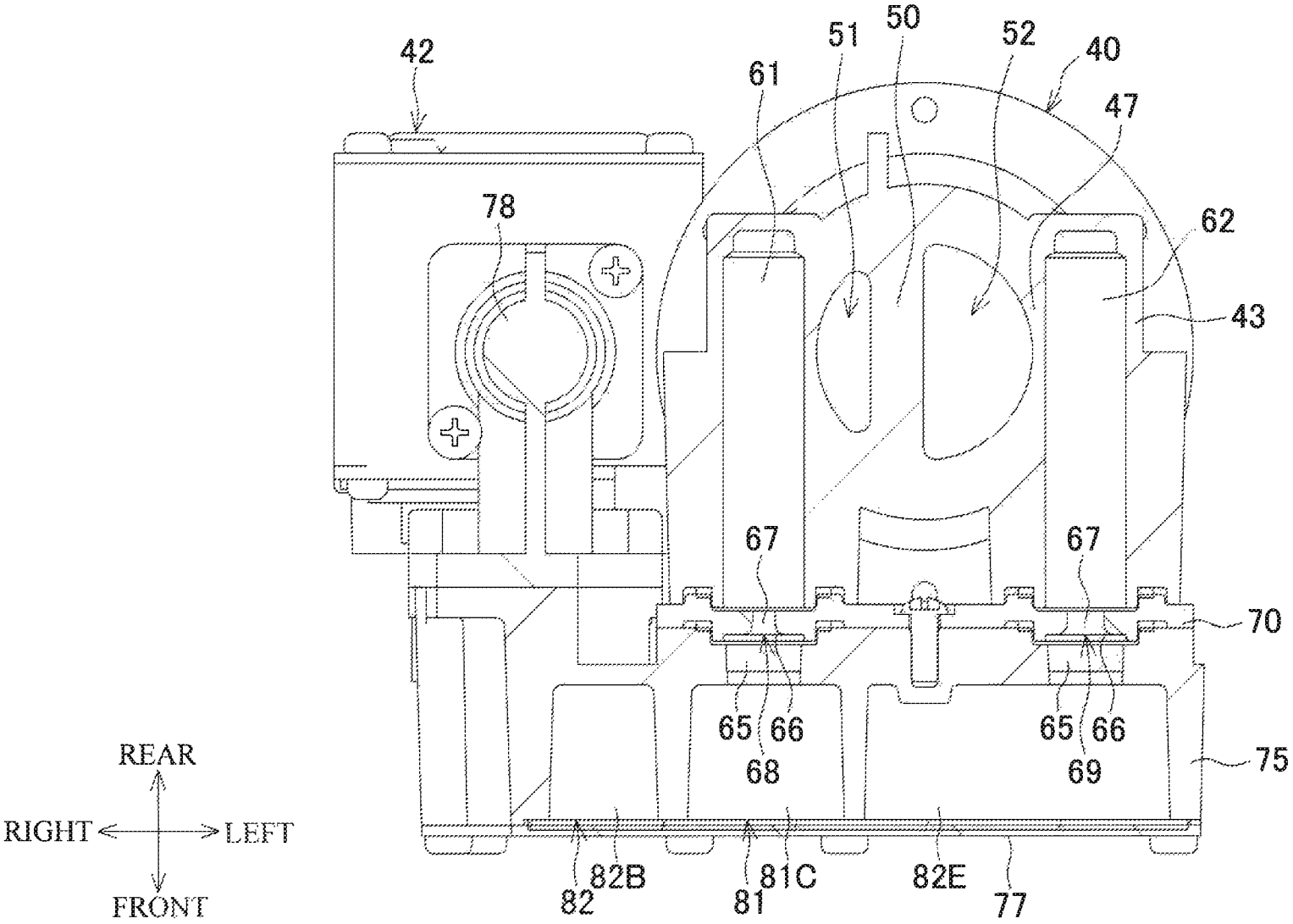
FIG. 11 is a cross-sectional view taken along a line E-E in FIG. 9.
Figure 12:
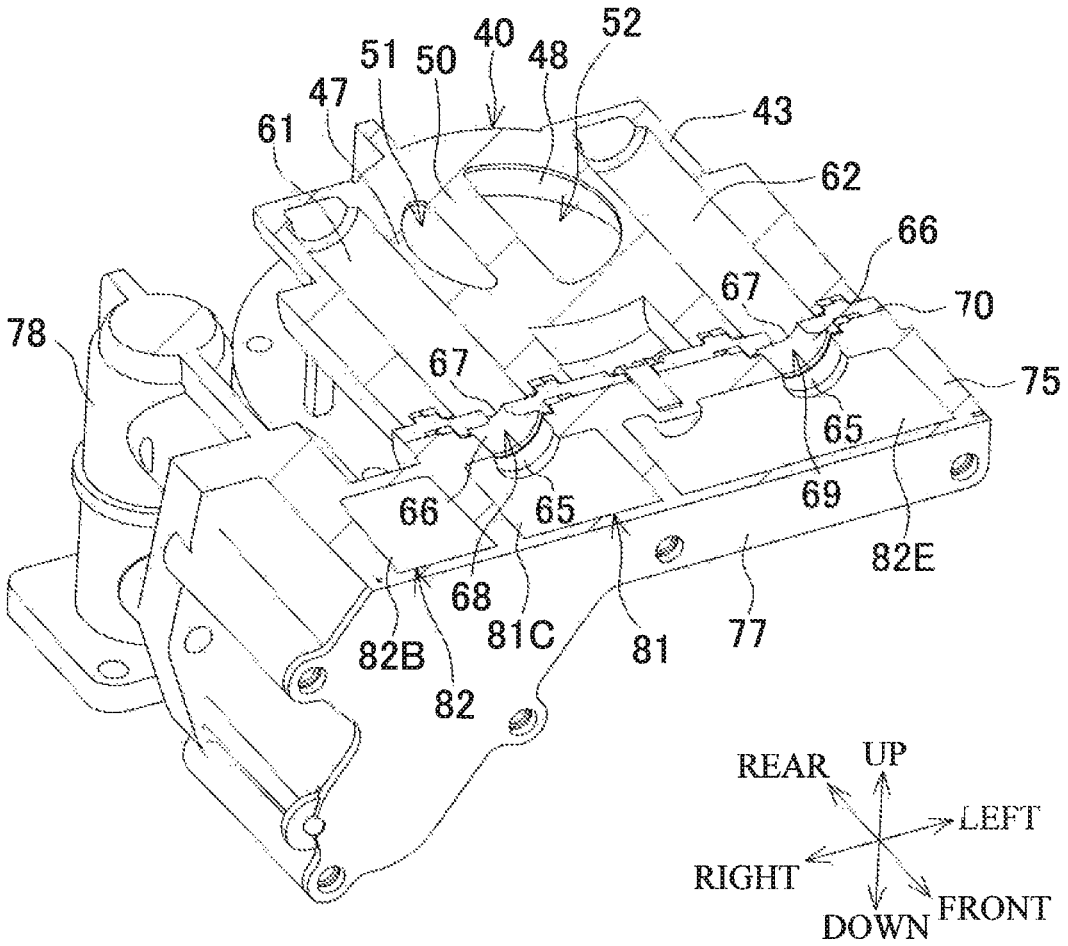
FIG. 12 is a perspective view of the structure in FIG. 11.
Figure 13C:
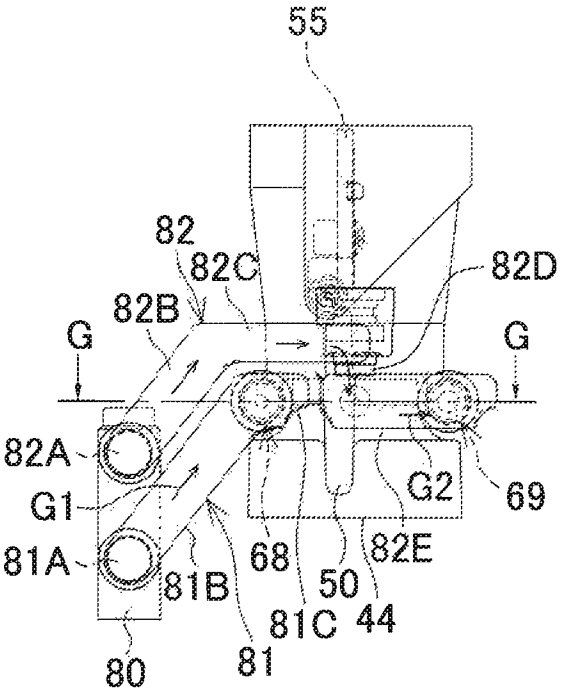
FIG. 13C is a front view of gas supply passages that are formed so as to diverge.
Figure 13A:
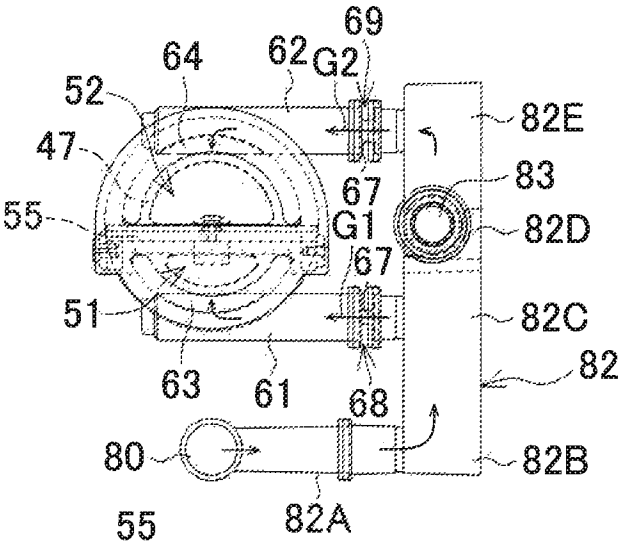
FIG. 13A illustrates a plan view of gas supply passages that are formed so as to diverge.
Figure 13B:
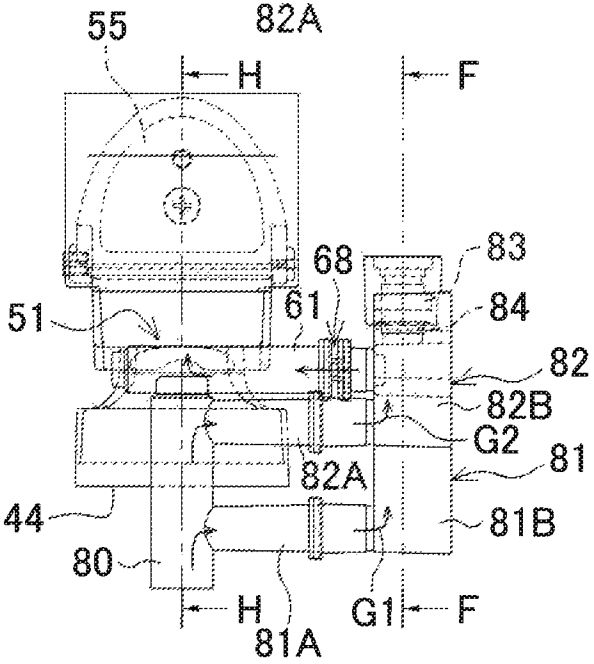
FIG. 13B is a side view of gas supply passages that are formed so as to diverge.

As shown in FIGS. 11 and 12, the front ends of the first and the second straight paths 61 and 62 communicate with a first gas passage 81 and a second gas passage 82, respectively, formed in the gas passage portion 41 as described below. At the front portions of the straight paths 61 and 62, introduction portions 65 and reduction portions 66 are formed. The introduction portions 65 communicate with the gas passages 81 and 82, respectively and each have an almost constant diameter in the front-rear direction. The reduction portions 66 have narrow holes 67 formed as narrowing portions, and are coaxial with the introduction portions 65. The front surface of each of the reduction portions 66 has its diameter reduced so as to form such a curved surface that is gradually oriented rearward from the outer circumference toward the center, similarly to the reduction portion 48 of the pressure reducing portion 47. Therefore, at the front portions of the first and the second straight paths 61 and 62, first and second nozzles 68 and 69 are formed as gas pressure reducing portions which guide fuel gas from the introduction portions 65 through the reduction portions 66 into the narrow holes 67 to reduce pressure, and inject the fuel gas in the rearward direction through the narrow holes 67. The diameter of the narrow hole 67 of the second nozzle 69 is greater than the diameter of the narrow hole 67 of the first nozzle 68.

The first and the second nozzles 68 and 69 are provided in a nozzle plate 70 that is held and fixed between the lower tube portion 43 and a front block 75. Therefore, by the nozzle plate 70 being removed, for example, cleaning or mending of the first and the second nozzles 68 and 69 can be easily performed. Furthermore, by the nozzle plate 70 being replaced, specifications of the reduction portion 66 or the narrow hole 67 can be easily changed.

Figure 9:
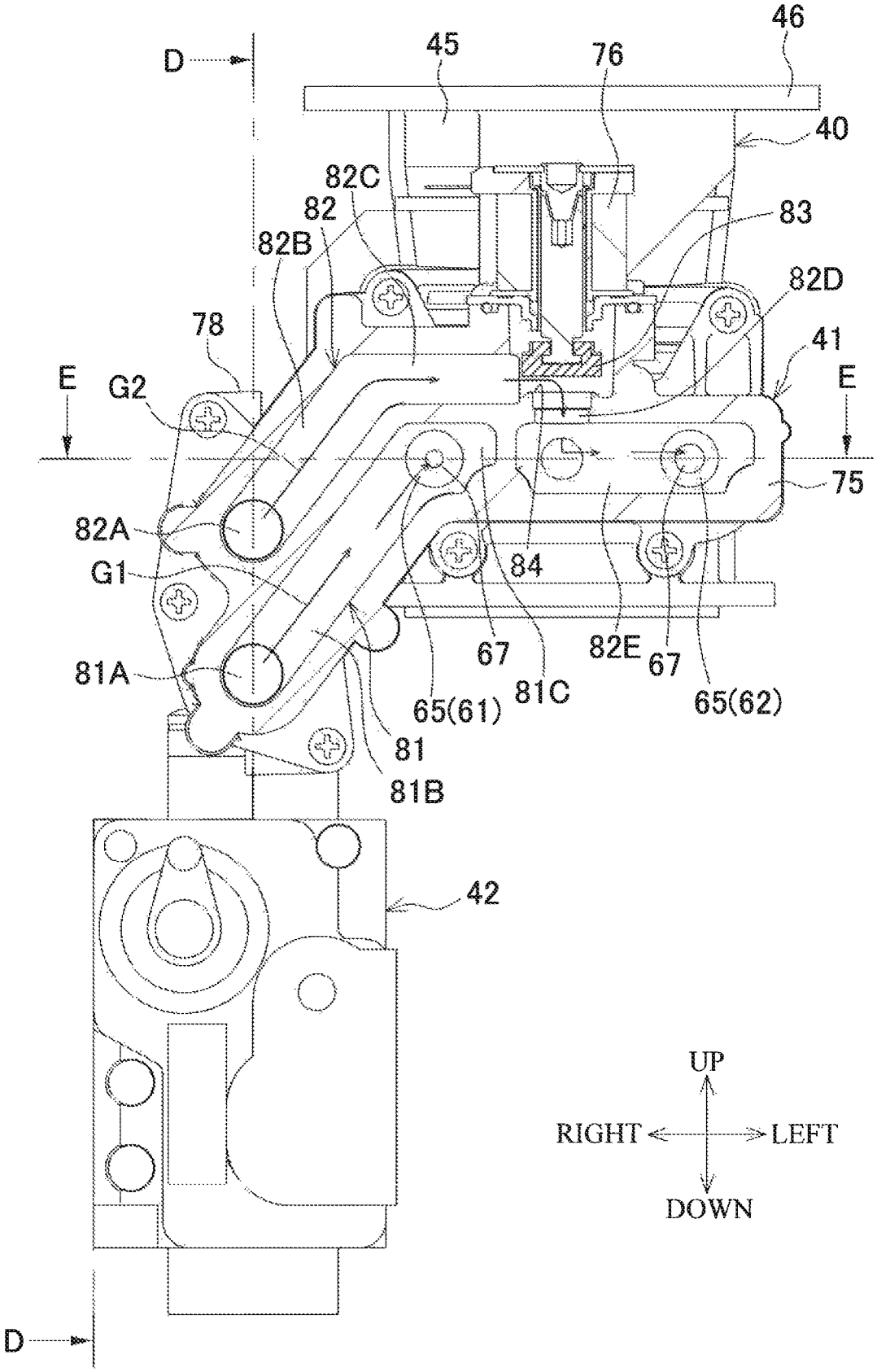
FIG. 9 is a cross-sectional view taken along a line C-C in FIG. 7A.
Figure 10:
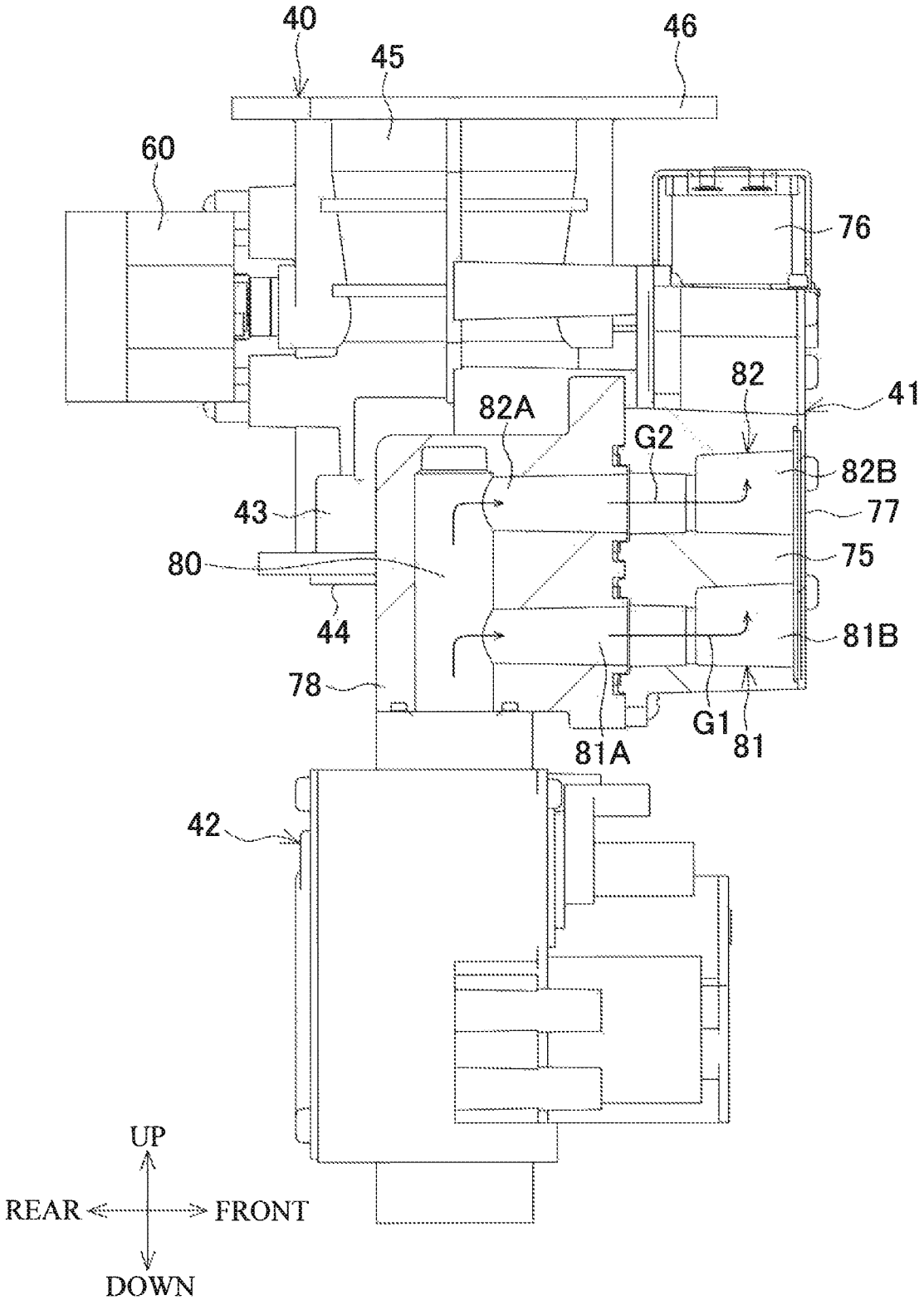
FIG. 10 is a cross-sectional view taken along a line D-D in FIG. 9.

As shown in FIGS. 9 and 10, the gas passage portion 41 has the front block 75, an electromagnetic valve 76, a closing plate 77, and a rear block 78. The front block 75 is connected to the front side of the mixing tube 40, extends in the right-left direction, and has its right end portion tilted diagonally downward. The electromagnetic valve 76 serves as a gas switching means and is disposed on the upper surface, on the left side, of the front block 75. The closing plate 77 closes the front surface of the front block 75. The rear block 78 is connected to the right end of the front block 75 from the rear side, extends in the up-down direction, and has its lower end connected to the equalizing valve 42. In the gas passage portion 41, an introduction passage 80, the first gas passage 81, and the second gas passage 82 are formed. The introduction passage 80 is disposed on the upstream end and is connected to an outlet of the equalizing valve 42. The first gas passage 81 has its upstream end connected to the introduction passage 80, and has its downstream end connected to the introduction portion 65 of the first straight path 61. The second gas passage 82 has its upstream end connected to the introduction passage 80, and has its downstream end connected to the introduction portion 65 of the second straight path 62.

As shown also in FIGS. 13A to 13C and 14A to 14C that independently illustrate the gas supply passage, the first gas passage 81 includes a front-rear passage portion 81A, a tilted passage portion 81B, and a left-right passage portion 81C. The front-rear passage portion 81A is connected to the lower side (upstream side) of the introduction passage 80, and extends forward over the rear block 78 and the front block 75. The tilted passage portion 81B extends so as to be tilted from the front end of the front-rear passage portion 81A along the tilted portion of the front block 75 toward the upper left side. The left-right passage portion 81C extends leftward from the upper end of the tilted passage portion 81B and is connected to the introduction portion 65 of the first straight path 61.

The second gas passage 82 includes a front-rear passage portion 82A, a tilted passage portion 82B, and an upper left-right passage portion 82C. The front-rear passage portion 82A is connected to the upper side (downstream side) of the introduction passage 80, and extends forward, above the front-rear passage portion 81A, over the rear block 78 and the front block 75. The tilted passage portion 82B extends above the tilted passage portion 81B so as to be tilted from the front end of the front-rear passage portion 82A along the tilted portion of the front block 75 toward the upper left side. The upper left-right passage portion 82C extends, above the left-right passage portion 81C, from the upper end of the tilted passage portion 82B toward the left side beyond the left-right passage portion 81C. The second gas passage 82 further includes an up-down passage portion 82D and a lower left-right passage portion 82E. The up-down passage portion 82D extends downward from the left end of the upper left-right passage portion 82C to a portion adjacent to the left side of the left-right passage portion 81C. The lower left-right passage portion 82E extends leftward from the lower end of the up-down passage portion 82D, and is connected to the introduction portion 65 of the second straight path 62.

Thus, the gas supply passage that diverges upward and downward from the outlet of the equalizing valve 42 to reach the first and the second communication openings 63 and 64 is formed independently into the gas supply passage on the first venturi 51 side and the gas supply passage on the second venturi 52 side, respectively. The gas supply passage on the first venturi 51 side diverges from the introduction passage 80 and extends through the first gas passage 81 and the first straight path 61 to reach the first communication opening 63. The gas supply passage on the second venturi 52 side diverges from the introduction passage 80 and extends through the second gas passage 82 and the second straight path 62 to reach the second communication opening 64. The first and the second gas passages 81 and 82 are made compact in the front-rear and right-left directions since the front-rear passage portion 81A and the front-rear passage portion 82A are parallel with each other so as to overlap each other in the up-down direction, the tilted passage portion 81B and the tilted passage portion 82B are parallel with each other so as to overlap each other in the up-down direction, and the left-right passage portion 81C and the upper left-right passage portion 82C are parallel with each other so as to overlap each other in the up-down direction, before the second gas passage 82 reaches the electromagnetic valve 76.

Furthermore, the second gas passage 82 that overlaps the first gas passage 81 on the upper side reaches the electromagnetic valve 76, and is thereafter bent downward, and extends downward by the up-down passage portion 82D so as to be positioned at the same height as the first gas passage 81. The first and the second straight paths 61 and 62 are connected to the first and the second communication openings 63 and 64 at the same height, whereby the two gas supply passages that extend from the electromagnetic valve 76 to the first and the second communication openings 63 and 64 can be easily formed.

As shown also in FIG. 9, a valve seat 84 on which a valve body 83 of the electromagnetic valve 76 is set is disposed in the inlet of the up-down passage portion 82D of the second gas passage 82. Selection from among a closing position at which the valve body 83 is set on the valve seat 84, and an opening position at which the valve body 83 is distant from the valve seat 84, can be made by driving the electromagnetic valve 76, whereby the second gas passage 82 can be optionally opened or closed.

The equalizing valve 42 has a publicly known structure in which a valve that operates by a diaphragm (not illustrated) is disposed to maintain a secondary-side pressure constant, and a gas tube in which a gas flow passage is opened or closed by an electromagnetic valve controlled by a controller (not illustrated) is connected to the inlet, to allow fuel gas to be supplied.

In the hot water supply apparatus 1 having the above-described structure, when water flows in the equipment, the controller drives the fan motor 28 at the number of revolutions corresponding to a combustion amount required by a remote controller or the like, to rotate the centrifugal fan 30, and, when the combustion amount is greater than or equal to a predetermined threshold value, the valve driving motor 60 is controlled to move the flap valve 55 to the opening position and open the second venturi 52.

Figure 14C:
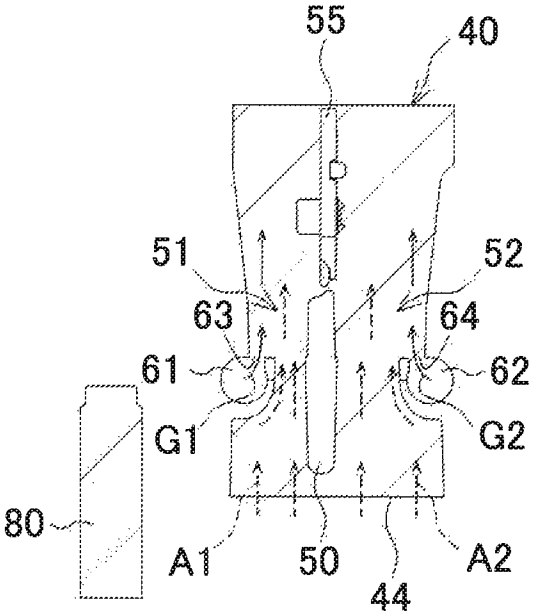
FIG. 14C illustrates a cross-section taken along a line H-H in FIG. 13B.
Figure 14B:
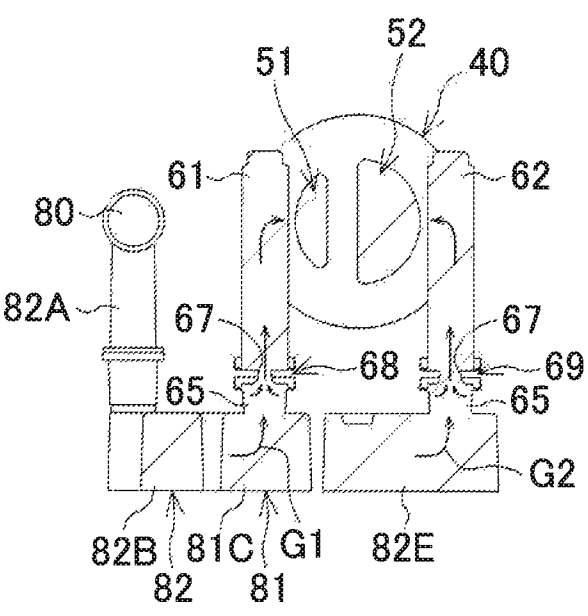
FIG. 14B illustrates a cross-section taken along a line G-G in FIG. 13C.
Figure 14A:
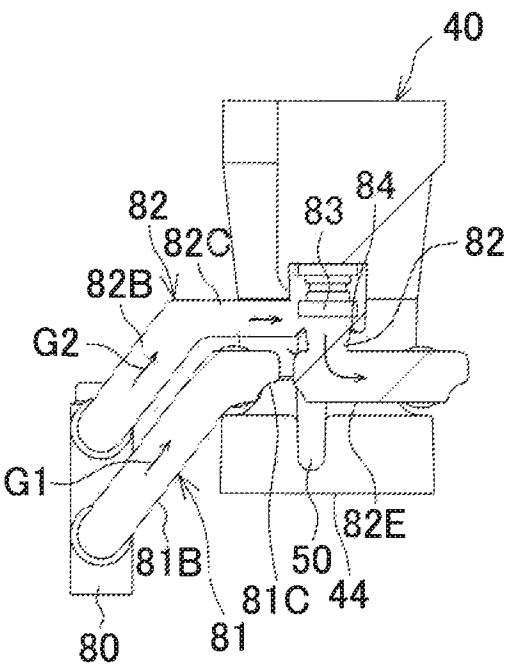
FIG. 14A illustrates a cross-section taken along a line F-F in FIG. 13B.

Then, in the mixing tube 40, air is drawn from the lower portion of the lower tube portion 43 through the introduction opening 44 in proportion to the number of revolutions of the centrifugal fan 30, and diverted into air A1 that flows on the side to the right of the partition wall 50 and air A2 that flows on the side to the left thereof as indicated by arrows drawn by dashed lines in FIG. 7B and FIG. 14C. The air A1 and the air A2 flow through the first and the second venturis 51 and 52, respectively, to the upper tube portion 45. At this time, the air A1 and the air A2 flow through the venturis 51 and 52, respectively, into the upper tube portion 45 at increased flow rates due to a passage area from the reduction portion 48 to the narrowing portion 49 being reduced. Therefore, pressure is reduced by the pressure reducing portion 47 to generate negative pressure.

At the same time, fuel gas is supplied from the gas tube, and flows through the equalizing valve 42 to the introduction passage 80 of the gas passage portion 41. Then, the fuel gas is diverted into gas G1 and gas G2, and the gas G1 flows in the first gas passage 81 and the gas G2 flows in the second gas passage 82 as indicated by arrows drawn by solid lines in FIGS. 9 and 10, and FIGS. 13A to 13C and 14A to 14C. The gas G1 in the first gas passage 81 flows through the front-rear passage portion 81A, the tilted passage portion 81B, and the left-right passage portion 81C in order, respectively, to the introduction portion 65 of the first straight path 61. The gas G2 in the second gas passage 82 flows through the front-rear passage portion 82A, the tilted passage portion 82B, the upper left-right passage portion 82C, the up-down passage portion 82D, and the lower left-right passage portion 82E in order, respectively, to the introduction portion 65 of the second straight path 62.

In the first and the second straight paths 61 and 62, the gas G1 and the gas G2 flow from the reduction portions 66 of the first and the second nozzles 68 and 69, respectively, through the narrow holes 67 to increase the flow rates, and are injected into the straight paths 61 and 62, respectively.

The gas G1 and the gas G2 are drawn, in amounts corresponding to differential pressures from negative pressures generated in the first and the second venturis 51 and 52, from the straight paths 61 and 62 through the first and the second communication openings 63 and 64, respectively, into the upper tube portion 45, and are mixed therein with the air A1 and the air A2 to generate air-fuel mixture.

In the description herein, the first and the second venturis 51 and 52 of the mixing tube 40 and the first and the second nozzles 68 and 69 of the straight paths 61 and 62 have the same nozzle shape. Therefore, a relationship between an amount of air that flows therethrough and reduction of pressure is the same, and change of an air ratio is constant even when an amount of gas changes according to an amount of air in each of the venturis 51 and 52.

Meanwhile, in a case where a required combustion amount is less than the predetermined threshold value, the valve driving motor 60 is controlled to move the flap valve 55 to the closing position and close the second venturi 52. At the same time, the valve body 83 of the electromagnetic valve 76 is caused to project so as to be positioned at the closing position, thereby closing the second gas passage 82. Therefore, air drawn by the centrifugal fan 30 is only the air A1 that flows through the first venturi 51 as shown in FIG. 8B. Fuel gas is only the gas G1 that flows from the introduction passage 80 of the gas passage portion 41 through the first gas passage 81. In the first straight path 61, the gas G1 flows from the reduction portion 66 of the first nozzle 68 through the narrow hole 67 to increase the flow rate, and is injected into the first straight path 61.

The gas G1 is drawn, in an amount corresponding to differential pressure from negative pressure generated in the first venturi 51, from the first straight path 61 through the first communication opening 63 into the upper tube portion 45. In the upper tube portion 45, the gas G1 is mixed with the air A1 to generate air-fuel mixture. Also, in this case, the first venturi 51 and the first nozzle 68 have the same nozzle shape, whereby change of an air ratio is constant even when an amount of gas changes according to an amount of air in the first venturi 51.

In the description herein, the first gas passage 81 and the first straight path 61, and the second gas passage 82 and the second straight path 62 independently diverge from the introduction passage 80 and are connected to the first and the second communication openings 63 and 64 of the first and the second venturis 51 and 52. Therefore, when only the first venturi 51 is singly used, air does not flow back from the second communication opening 64 on the closed second venturi 52 side into the second straight path 62 and the second gas passage 82, so that the air is not mixed with the gas G1 in the first gas passage 81. In particular, in the second gas passage 82 which is not used, the electromagnetic valve 76 physically closes the second gas passage 82, thereby more assuredly preventing backflow of air.

Thus, air-fuel mixture generated in the mixing tube 40 is drawn through the intake opening 31 into the fan case 27 and is fed through the blowout opening 32 into the deep bottom portion 12 of the burner unit 3. Then, the air-fuel mixture is injected through each flame hole 14 of the flame hole plate 13, is ignited by an ignition electrode (not illustrated), and is combusted.

Combustion exhaust from the burner unit 3 passes between the fins 16 in the intermediate casing 15 of the primary heat exchanger 4, whereby heat-exchange with water that flows in the heat transfer tube 17 occurs to recover sensible heat. Thereafter, the combustion exhaust passes between the heat transfer plates 21 in the lower casing 20 of the secondary heat exchanger 5, whereby heat-exchange with water that flows in an internal flow passage of the heat transfer plate 21 occurs to recover latent heat. The combustion exhaust is moved upward in the exhaust unit 6 and discharged from the exhaust pipe 26.

Thus, the premixing device 8 and the hot water supply apparatus 1 according to the above-described embodiment includes the two venturis that are the first and the second venturis 51 and 52, the first and the second communication openings 63 and 64, the opening and closing means (flap valve 55), and the equalizing valve 42. In the first and the second venturis 51 and 52, air flows by rotation of the centrifugal fan 30. The first and the second communication openings 63 and 64 are disposed in the venturis 51 and 52, respectively, and allow fuel gas supplied from the gas supply passage to flow out. The opening and closing means (flap valve 55) can open and close the second venturi 52 on the side downstream of the second communication opening 64. The equalizing valve 42 is disposed in the gas supply passage on the side upstream of the first and the second communication openings 63 and 64. Selection from among a case where both the venturis 51 and 52 are used, and a case where the second venturi 52 is closed, and only the first venturi 51 is used, is made. Therefore, a turndown ratio can be increased, and the minimum gas amount can be reduced. Thus, usability is improved.

The gas supply passage that connects between the outlet of the equalizing valve 42, and the two communication openings that are the first and the second communication openings 63 and 64 diverges from the outlet of the equalizing valve 42 to independently form the first gas passage 81 and the first straight path 61, and the second gas passage 82 and the second straight path 62 for the venturis 51 and 52, respectively. Therefore, when the second venturi 52 is closed, backflow of air from the second communication opening 64 can be prevented. Thus, change of balance of an air ratio or the like in combustion can be inhibited with a simple structure, and air can be prevented from being excessively contained in air-fuel mixture.

Furthermore, the second gas passage 82, which diverges and is formed on the second venturi 52 side where the flap valve 55 is disposed, includes the gas switching means (electromagnetic valve 76). The gas switching means (electromagnetic valve 76) can open and close the second gas passage 82, and closes the second gas passage 82 when the second venturi 52 is closed by the flap valve 55. Therefore, backflow of air can be assuredly prevented when the first venturi 51 is singly used.

Furthermore, the first and the second gas passages 81 and 82 that form the two gas supply passages diverge upward and downward from the outlet of the equalizing valve 42, and are parallel with each other so as to overlap each other in the up-down direction before the second gas passage 82 reaches the electromagnetic valve 76. Therefore, the two gas supply passages can be formed so as to save a space.

In addition, the second gas passage 82 that overlaps the first gas passage 81 on the upper side reaches the electromagnetic valve 76, and is thereafter bent downward, and extends downward so as to be positioned at the same height as the first gas passage 81. The first and the second straight paths 61 and 62 of the two gas supply passages are connected to the first and the second communication openings 63 and 64 at the same height. Therefore, the two gas supply passages that extend from the electromagnetic valve 76 to the first and the second communication openings 63 and 64 can be easily formed.

In the above-described embodiment, the electromagnetic valve 76 is disposed in the second gas passage 82. However, another mechanism such as a flap valve may be used as the gas switching means. Furthermore, such gas switching means may be omitted. The structure for diverging and forming the gas supply passage is not limited to the above-described structure. Each gas supply passage may be diverged and formed by using piping without using the block.

Furthermore, in the disclosure of the gas supply passage, the first and the second nozzles of the first and the second straight paths may not necessarily be provided. The gas supply passage that does not have such a gas pressure reducing portion may be diverged and formed from the outlet of the equalizing valve to the first and the second communication openings.

Thus, in the premixing device 8 and the hot water supply apparatus 1 according to the above-described embodiment, the first and the second straight paths 61 and 62 of the gas supply passage include the gas pressure reducing portions (the first and the second nozzles 68 and 69) for reducing pressure of fuel gas. The gas pressure reducing portions (the first and the second nozzles 68 and 69) are formed so as to have the same shape as the pressure reducing portion 47 of the first and the second venturis 51 and 52. Therefore, imbalance between a relationship between an amount of air and reduction of pressure in the pressure reducing portion 47, and a relationship between an amount of gas and reduction of pressure in the gas pressure reducing portion (the first and the second nozzles 68 and 69) does not occur. Therefore, even if an amount of air and an amount of gas are restricted, change of an air ratio can be made constant, and change of an air-fuel ratio can be inhibited.

In particular, in the description herein, the pressure reducing portion 47 and the gas pressure reducing portion (the first and the second nozzles 68 and 69) have nozzle shapes, whereby balance in change of pressure loss can be more advantageously maintained.

Furthermore, each nozzle shape is formed so as to include the narrowing portion (narrowing portion 49, narrow hole 67) and the reduction portions 48 and 66. The narrowing portion (narrowing portion 49, narrow hole 67) narrows the flow passage. The reduction portions 48 and 66 reduce the flow passage from the side upstream of the narrowing portion toward the narrowing portion so as to form a curved surface. Therefore, the nozzle shape by which passage resistance is less likely to occur can be formed.

Furthermore, the first and the second nozzles 68 and 69 are formed such that the separate nozzle plate 70 having a nozzle shape is detachably mounted onto the first and the second straight paths 61 and 62. Therefore, maintenance or change of specifications of the nozzle shape can be easily performed by the nozzle plate 70 being removed or replaced.

The shape of the reduction portions 48 and 66 is not limited to a curved surface, and may be changed as appropriate to, for example, a tapered shape having a linearly reduced diameter.

In the above-described embodiment, both the pressure reducing portion and the gas pressure reducing portion have nozzle shapes. However, each of the pressure reducing portion and the gas pressure reducing portion may have an orifice shape when the pressure reducing portion and the gas pressure reducing portion have the same shape. Also, in this case, imbalance between a relationship between an amount of air and reduction of pressure in the venturi-side pressure reducing portion and a relationship between an amount of gas and reduction of pressure in the gas pressure reducing portion can be prevented.

Furthermore, in the disclosure of the pressure reducing portion and the gas pressure reducing portion, the number of the venturis may not necessarily be two. Even when the number of the venturis is one, when the pressure reducing portion and the gas pressure reducing portion have the same shape, an effect of inhibiting an air-fuel ratio from changing can be obtained as in the above-described embodiment.

Moreover, throughout the embodiments of the disclosure, the structure of the hot water supply apparatus itself is not limited to the structure according to the above-described embodiments. The fan may be disposed on the upstream side of the venturi or the secondary heat exchanger may not be provided. Even in this case, each embodiment of the disclosure is applicable.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

What is claimed is:

1. A premixing device for generating air-fuel mixture by mixing fuel gas with air by using a fan to supply the air-fuel mixture to a burner, the premixing device comprising:

two venturis in which air flows by rotation of the fan;

a communication opening disposed in each of the venturis, the communication opening configured to allow fuel gas supplied from a gas supply passage to flow out;

an opening and closing member capable of opening and closing one of the venturis on a side downstream of the communication opening; and an equalizing valve disposed in the gas supply passage on a side upstream of the communication opening, wherein the gas supply passage that connects between an outlet of the equalizing valve and the two communication openings diverges from the outlet of the equalizing valve to form independent gas supply passages for the venturis, respectively, wherein the gas supply passage, which diverges and is formed for one of the venturis where the opening and closing member is disposed, includes a gas switching device that can open and close the gas supply passage and that closes the gas supply passage when the one of the venturis is closed by the opening and closing member, wherein two gas supply passages are parallel with each other so as to overlap each other in an up-down direction before one of the gas supply passages reaches the gas switching device, wherein the one of the gas supply passages which overlaps the other thereof on an upper side reaches the gas switching device, and is thereafter bent downward, and extends downward so as to be positioned at the same height as the other of the gas supply passages, and the two gas supply passages are connected to the communication openings at the same height.

2. A combustion device comprising:

the premixing device according to claim 1;

a fan configured to allow air to flow in the two venturis of the premixing device; and a burner to which air-fuel mixture generated by the premixing device is supplied.

* * * * *